US009277327B2

(12) United States Patent
Terazono et al.

(10) Patent No.: US 9,277,327 B2
(45) Date of Patent: Mar. 1, 2016

(54) ACOUSTIC GENERATOR, ACOUSTIC GENERATING DEVICE, AND ELECTRONIC DEVICE

(71) Applicant: KYOCERA Corporation, Kyoto-shi, Kyoto (JP)

(72) Inventors: Masaki Terazono, Kirishima (JP); Shigenobu Nakamura, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 14/369,894

(22) PCT Filed: Jul. 31, 2013

(86) PCT No.: PCT/JP2013/070780
§ 371 (c)(1),
(2) Date: Jun. 30, 2014

(87) PCT Pub. No.: WO2014/045719
PCT Pub. Date: Mar. 27, 2014

(65) Prior Publication Data

US 2015/0003643 A1 Jan. 1, 2015

(30) Foreign Application Priority Data

Sep. 19, 2012 (JP) ..... 2012-206317

(51) Int. Cl.
*H04R 1/00* (2006.01)
*H04R 17/00* (2006.01)
(Continued)

(52) U.S. Cl.
CPC ..... *H04R 17/00* (2013.01); *H04R 1/00* (2013.01); *H04R 7/20* (2013.01); *H04R 31/006* (2013.01); *H04R 7/08* (2013.01); *H04R 7/26* (2013.01); *H04R 9/066* (2013.01); *H04R 19/02* (2013.01);
(Continued)

(58) Field of Classification Search
CPC ..... H04R 7/04; H04R 7/045; H04R 7/18; H04R 7/20; H04R 7/22; H04R 17/00; H04R 2307/204
See application file for complete search history.

(56) References Cited

U.S. PATENT DOCUMENTS 5,790,679 A * 8/1998 Hawker ..... H04M 1/0202 379/388.02
5,906,887 A * 5/1999 Withers ..... B32B 5/26 428/141
(Continued)

FOREIGN PATENT DOCUMENTS

JP 2001-024460 A 1/2001
JP 2001-285994 A 10/2001
(Continued)

OTHER PUBLICATIONS

International Search Report, PCT/JP2013/070780, Sep. 30, 2013, 2 pgs.

*Primary Examiner* — Curtis Kuntz
*Assistant Examiner* — Ryan Robinson
(74) *Attorney, Agent, or Firm* — Volpe and Koenig, P.C.

(57) ABSTRACT

An acoustic generator includes a vibrating body. The acoustic generator includes a frame member attached by a bonding material to an external peripheral portion of the vibrating body. The acoustic generator has an exciter provided on the vibrating body inside of the frame member. In this case, the acoustic generator further includes an extended portion of the bonding material provided to be extended on the vibrating body inside of the frame from the frame member.

14 Claims, 6 Drawing Sheets

(51) Int. Cl.

| | |
|---|---|
| ***H04R 7/20*** | (2006.01) |
| ***H04R 31/00*** | (2006.01) |
| *H04R 7/26* | (2006.01) |
| *H04R 19/02* | (2006.01) |
| *H04R 9/06* | (2006.01) |
| *H04R 7/08* | (2006.01) |

(52) U.S. Cl.
CPC ..... *H04R 2217/00* (2013.01); *H04R 2307/201* (2013.01); *H04R 2307/207* (2013.01); *H04R 2499/11* (2013.01)

(56) References Cited

U.S. PATENT DOCUMENTS

| | | | | | |
|---|---|---|---|---|---|
| 5,908,887 | A * | 6/1999 | Tondre | C08K 3/22 | 428/458 |
| 6,205,226 | B1 * | 3/2001 | Senoo | H04R 17/00 | 310/311 |
| 6,472,797 | B1 * | 10/2002 | Kishimoto | H04R 17/00 | 310/324 |
| 7,671,517 | B2 * | 3/2010 | Ishimasa | H04R 17/00 | 310/330 |
| 2013/0094681 | A1 | 4/2013 | Fukuoka et al. | | |

FOREIGN PATENT DOCUMENTS

| | | | | |
|---|---|---|---|---|
| JP | 2004-023436 | A | 1/2004 | |
| JP | 2010-103977 | A | 5/2010 | |
| JP | 2011-249990 | A | 12/2011 | |
| JP | 2012-110018 | A | 6/2012 | |
| WO | WO 2011162002 | A1 * | 12/2011 | H04R 17/00 |

* cited by examiner

ACOUSTIC GENERATOR, ACOUSTIC GENERATING DEVICE, AND ELECTRONIC DEVICE

FIELD

Embodiments disclosed herewith relate to an acoustic generator, an acoustic generating device, and an electronic device.

BACKGROUND

An acoustic generator such as a piezoelectric speaker has conventionally been known as a small and low-current driven sound device in which a piezoelectric substance is used as an electroacoustic transducer, and is used as an acoustic generating device incorporated into a small electronic device such as a mobile computing device.

In general, an acoustic generator in which a piezoelectric substance is used for an electroacoustic transducer has such a structure in which a piezoelectric element serving as an exciter formed with electrodes made of, e.g., thin silver film is pasted to a metal diaphragm. A sound generation mechanism of the acoustic generator in which the piezoelectric substance is used for the electroacoustic transducer generates distortion in the form of the piezoelectric element by applying an alternate current voltage to both surfaces of the piezoelectric element, and transmits the distortion in the form of the piezoelectric element to the metal diaphragm, thereby generating sound.

An acoustic generator using a resin film as a diaphragm instead of a metal diaphragm is also known. In this acoustic generator, a bimorph multilayer piezoelectric element is sandwiched by a pair of resin films in the thickness direction, and further, this resin film is fixed to a frame member with a tension. Accordingly, this improves the sound conversion efficiency, and enables generation of a high level sound pressure.

CITATION LIST

Patent Literature

Patent Literature 1: Japanese Laid-open Patent Publication No. 2004-023436

Patent Literature 2: Japanese Laid-open Patent Publication No. 2001-285994

SUMMARY

An acoustic generator according to an aspect of embodiments includes a vibrating body, a frame member attached by a boding material to an external peripheral portion of the vibrating body, an exciter provided on the vibrating body inside of a frame of the frame member, and an extended portion of the bonding material which extends onto the vibrating body inside of the frame from the frame member.

DESCRIPTION OF EMBODIMENTS

Embodiments of an acoustic generator, an acoustic generating device, and an electronic device according to the present disclosure will be hereinafter described in details with reference to drawings. It is to be understood that the embodiments are not intended to limit the present disclosure. In each mode shown below as an embodiment for example, the shapes and dimensions of the members constituting the acoustic generator can be combined appropriately within the range that does not cause any contradiction.

First Embodiment

Structure of Acoustic Generator

Figure 1A:
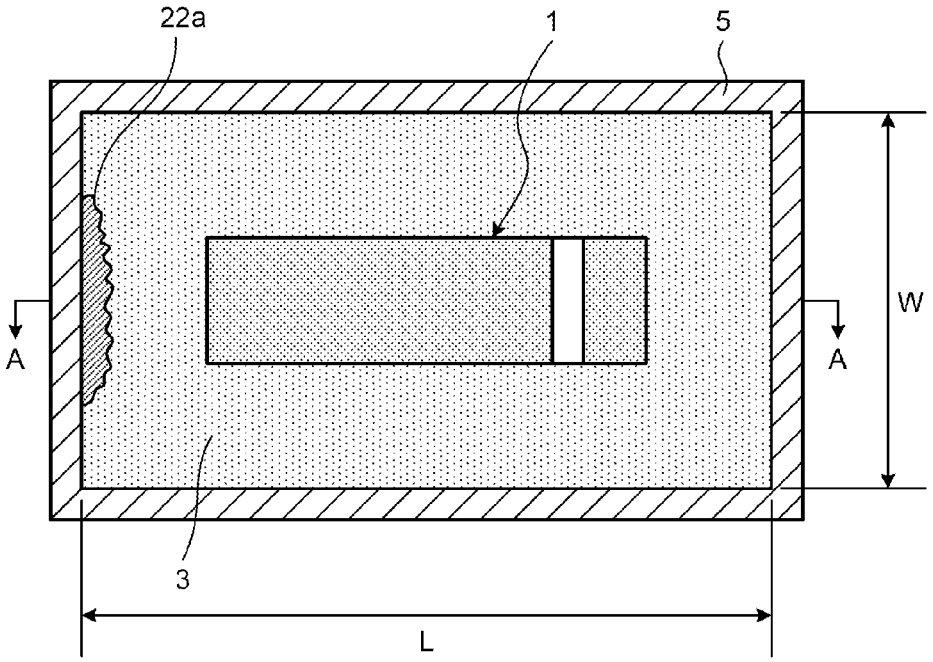
FIG. 1A is a top view illustrating an acoustic generator according to a first embodiment.
Figure 1B:
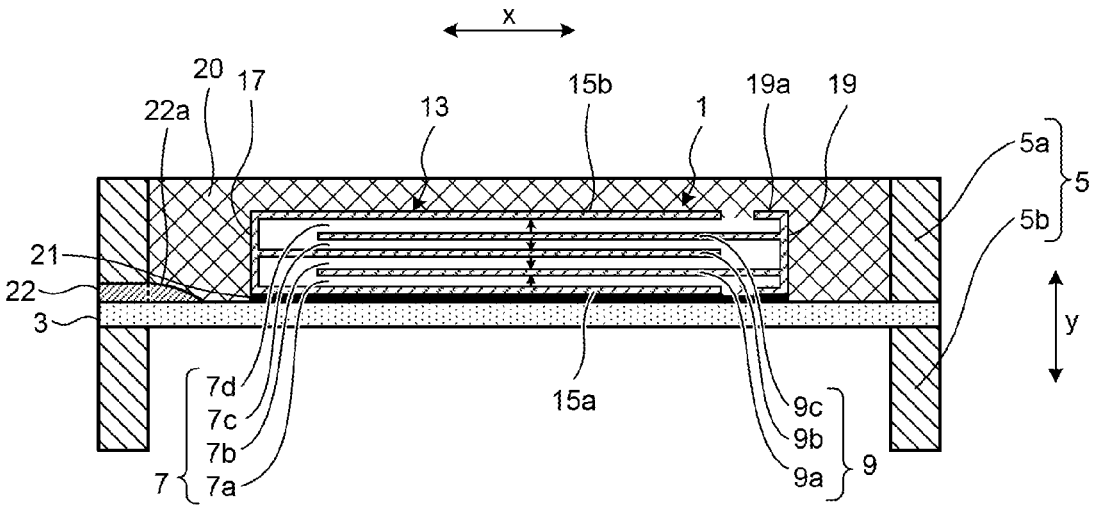
FIG. 1B is a cross sectional view illustrating the acoustic generator according to the first embodiment.

First, the first embodiment of the acoustic generator will be described with reference to FIGS. 1A and 1B. FIG. 1A is a top view illustrating the acoustic generator according to the first embodiment. FIG. 1B is a cross sectional view illustrating the acoustic generator according to the first embodiment. FIG. 1B shows a cross sectional view taken along line A-A of FIG. 1A. In FIG. 1B, the multilayer piezoelectric element 1 shown as the exciter 1 is enlarged in the thickness direction (y direction) for the sake of easy understanding.

In the present embodiment, a case where the exciter 1 is a piezoelectric element has been described as an example, but the exciter 1 is not limited to the piezoelectric element. The exciter 1 may be any element as far as it has a function of receiving an electric signal and vibrates according to the electric signal. For example, the exciter 1 may be a dynamic exciter which is well known as an exciter for vibrating a speaker, an electrostatic exciter, or an electromagnetic exciter. The dynamic exciter is something that vibrates a coil by passing an electric current through the coil arranged between magnetic poles of a permanent magnet. The electrostatic exciter is something that vibrates a metal plate by passing a bias and an electric signal to two metal plates facing each other. The electromagnetic exciter is something that vibrates a thin steel plate by passing an electric signal through a coil. The exciter applied to the acoustic generator of the present embodiment is preferably a piezoelectric element because it can be made thinner and lighter, and the change of the diaphragm is small. In the present embodiment, the vibrating body is, for example, a film.

The acoustic generator according to the first embodiment as shown in FIGS. 1A and 1B has a film 3 serving as a support plate attached to a frame member 5 having a central area opened in a quadrilateral shape, and an exciter 1 is provided on one of principle surface sides of the film 3. More specifically, the multilayer piezoelectric element 1 as shown in FIG. 1B, for example, is bonded to the upper surface of the film 3 serving as the support plate sandwiched by the frame members 5*a*, 5*b*. In other words, as shown FIG. 1B, the acoustic generator according to the first embodiment is configured such that the film is sandwiched by the first and second frame members 5*a*, 5*b* while tension is given thereto, and the film 3 is thereby fixed to the first and second frame members 5*a*, 5*b*. The piezoelectric element 1 is arranged on the top surface of the film 3. In addition to the configuration as shown in FIG. 1B in which the film 3 is sandwiched by the pair of frame members 5*a*, 5*b*, the film 3 may also have such a configuration that a frame member 5 is attached to only one side of the film 3 as described later.

In this case, in the acoustic generator according to the first embodiment, a bonding material 22 is used when the frame member 5*a* is attached to the film 3. For example, the bonding material 22 may be a publicly known material such as epoxy resin, silicone resin, and polyester resin. The method for curing the resin used for the bonding material 22 may be any method such as thermosetting, photo-setting, and anaerobic curing.

Then, the bonding material 22 has an extended portion 22*a* extended from between the frame member 5*a* and the film 3 to the inside of the frame of the frame member 5*a* to be extended on the film 3. Hereinafter, the extended portion 22*a* of the bonding material 22 formed from between the frame member 5*a* and the film 3 to the upper surface of the film 3 will be described with reference to FIG. 1C.

Figure 1C:
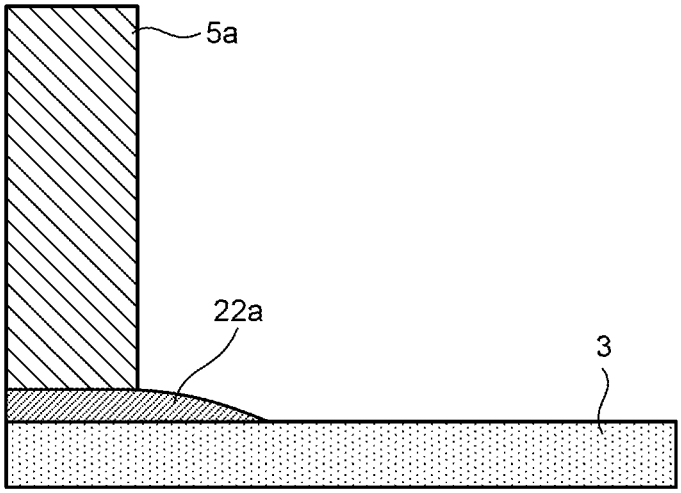
FIG. 1C is a cross sectional view illustrating an extended portion of a bonding material.

FIG. 1C is a cross sectional view illustrating the extended portion of the bonding material. As shown in FIG. 1C, the frame member 5 is attached to the film 3 with the bonding material 22 interposed therebetween. In this case, the bonding material 22 extends to the film 3 in the frame, and a portion of the bonding material 22 is extended on the film 3. As described above, the acoustic generator according to the first embodiment has the extended portion 22*a* of the bonding material 22 extended from between the frame member 5*a* and the film 3 to the upper surface of the film 3. Therefore, areas where the displacements are different during vibration can be provided on the film 3 in a dispersed manner. As a result, in the acoustic generator according to the first embodiment, the displacements that occur when each area of the film 3 vibrates can be made uneven displacements. Therefore, the sound pressure peak at the resonance point can be made into a gentle peak when the film 3 vibrates, and the peaks and dips are suppressed, so that the frequency characteristics can be flattened. Making the displacements uneven when each area of the film 3 vibrates means that the amplitudes of vibrations are different between an area which is in contact with the extended portion 22*a* and an area which is not in contact with the extended portion 22*a*

The extension width (extension distance) of the extended portion 22*a* is, for example, 0.05 to 2.0 mm, and more preferably, 0.1 to 1.0 mm in the cross section of FIG. 1C.

As shown in FIG. 1A, when the film 3 is seen in the top view, at least a portion of the extended portion 22*a* may be in an undulated shape. In this case, the portion in the undulated shape means a wavy portion where the external peripheral surface (the external edge of the extended portion 22*a* in the top view) is projecting or depressed, and the degree of the wave (amplitude) is such that, for example, the length drawn perpendicular to the line segment connecting between the apexes of two adjacent peaks from the apex of the bottom located between the two adjacent peaks of the wave is equal to or more than 0.05 mm. The length of the line segment connecting between the apexes of the two adjacent peaks is equal to or more than, for example, 0.1 mm.

For example, the piezoelectric element 1 is formed in a plate like shape, and the upper and lower principle surfaces are in any one of a square shape, a rectangular shape, and a polygonal shape. For example, such piezoelectric element 1 includes a laminated body 13 made by alternately stacking one of four layers of ceramics included in a piezoelectric substance layer 7 and one of three layers of internal electrode layers 9, surface electrode layers 15*a*, 15*b* formed on both of the upper and lower surfaces of the laminated body 13, and a pair of external electrodes 17, 19 provided at both end portions of the laminated body 13 in the longitudinal direction x.

The external electrode 17 is connected to the surface electrode layers 15*a*, 15*b* and an internal electrode layer 9*b*. The external electrode 19 is connected to two internal electrode layers 9*a*, 9*c*. The piezoelectric substance layer 7 is polarized as indicated by arrows in FIG. 1B. The piezoelectric substance layer 7 is configured such that a voltage is applied to the external electrodes 17, 19 so that when piezoelectric substance layers 7*a*, 7*b* shrink, piezoelectric substance layers 7*c*, 7*d* extend; or alternatively, when the piezoelectric substance layers 7*a*, 7*b* extend, the piezoelectric substance layers 7*c*, 7*d* shrink.

The upper and lower end portions of the external electrode 19 are arranged to be extended to the upper and lower surfaces of the laminated body 13, and are arranged with bent-back external electrodes 19*a*. These bent-back external electrodes 19*a* are provided to extend with a predetermined distance from the surface electrode layers 15*a*, 15*b* so as not to be in contact with the surface electrode layers 15*a*, 15*b* formed on the surface of the laminated body 13.

The piezoelectric substance layer 7 having four layers and the internal electrode layer 9 having three layers are formed by being fired at a time while being stacked, and the surface electrode layers 15*a*, 15*b* are formed by applying a paste and firing them after the laminated body 13 is produced.

The principle surface of the piezoelectric element 1 at the film 3 and the film 3 are bonded by a bonding material 21. The thickness of the bonding material 21 between the piezoelectric element 1 and the film 3 is, for example, equal to or more than 0.02 μm and equal to or less than 20 μm, and in particular, the thickness of the bonding material 21 is desirably equal to or less than 10 μm. As described above, when the thickness of the bonding material 21 is equal to or less than 20 μm, the vibration of the laminated body 13 can be easily transmitted to the film 3.

The bonding material 21 may be a publicly known material such as epoxy resin, silicone resin, and polyester resin. The method for curing the resin used for the bonding material 21 may be any method such as thermosetting, photo-setting, and anaerobic curing.

The acoustic generator according to the first embodiment includes a resin layer 20 provided on the extended portion 22*a* and on the film 3 (vibrating body) between the piezoelectric element 1 (exciter) and the frame member 5*a*. More specifically, the resin layer 20 is formed by filling the inside of the frame member 5*a* with resin so that the piezoelectric element 1 is buried therein. In FIG. 1A, the resin layer is not illustrated for the sake of easy understanding.

The resin layer 20 may be epoxy resin, acrylic resin, silicon resin, rubber, and the like. From the perspective of suppressing spurious, the resin layer 20 is preferably applied in such a manner that the layer completely covers the piezoelectric element 1. Further, since the film 3 serving as the support plate also vibrates together with the piezoelectric element 1, the resin layer 20 preferably also covers the area of the film 3 not covered by the piezoelectric element 1 in the same manner.

As described above, in the acoustic generator according to the first embodiment, the piezoelectric element 1 is buried in the resin layer 20, and this can induce appropriate dumping effects for the peaks and dips caused by the resonance phenomenon of the piezoelectric element 1. With such dumping effects, the resonance phenomenon can be suppressed, and the peaks and the dips can also be suppressed to a low level. As a result, the frequency dependency of the sound pressure can be reduced.

It should be noted that the piezoelectric substance layer 7 may be already-available piezoelectric ceramics such as lead zirconate (PZ), lead zirconate titanate (PZT), Bi layered compound, tungsten bronze structure compound, and other non-lead piezoelectric substance materials. From the view point of low voltage driving, the thickness of the piezoelectric substance layer 7 is preferably, for example, 10 to 100 μm.

The material of the internal electrode layer 9 is preferably a material that includes a metal component mainly including silver and palladium and a material component constituting the piezoelectric substance layer 7. Since the internal electrode layer 9 includes the ceramics component constituting the piezoelectric substance layer 7, this can reduce the stress caused by the difference in the thermal expansion between the piezoelectric substance layer 7 and the internal electrode layer 9, and the piezoelectric element 1 without any failure in lamination can be obtained. The internal electrode layer 9 is not particularly limited to metal a component made of silver and palladium, and may be other metal components. The ceramics component is not limited to the material component constituting the piezoelectric substance layer 7, and may be other ceramics components.

The materials of the surface electrode layers 15*a*, 15*b* and the external electrodes 17, 19 are desirably metal components mainly including silver and additional glass component. When the glass component is included, a strong adhesive force can be obtained between the piezoelectric substance layer 7 and the internal electrode layer 9 and the surface electrode layers 15 or the external electrodes 17, 19.

The frame members 5*a*, 5*b* are made of, for example, stainless steel of which thickness is 100 to 5000 μm. It should be noted that the materials of the frame members 5*a*, 5*b* are not limited to stainless steel. It may be a material that is less likely to deform as compared with the resin layer 20. For example, hard resin, plastic, engineering plastic, ceramics, and the like can be used. In the present embodiment, the material, the thickness, and the like of the frame members 5*a*, 5*b* are not particularly limited. Further, the shape of the frame is not limited to a rectangular shape. The shape of the frame may be configured such that a part of the inner peripheral portion is in a circular shape, an elliptic shape, or a rhombic shape. Alternatively, the shape of the frame may be configured such that all of the inner peripheral portions are in a circular shape, an elliptic shape, or a rhombic shape. Likewise, the external peripheral portion may be in a circular shape, an elliptic shape, or a rhombic shape.

As described above, the film 3 is configured such that the external peripheral portion of the film 3 is sandwiched between the frame members 5*a*, 5*b*. Accordingly, while tension is given to the film 3 in the surface direction, the film 3 is fixed to the frame members 5*a*, 5*b* by the bonding material 22, and the film 3 serves as the diaphragm. The thickness of the film 3 is, for example, 10 to 200 μm. For example, a resin such as polyethylene, polyimide, polypropylene, polystyrene, or paper made of pulp or fibers can be preferably used as the material of the film 3. When such materials are used, the peaks and the dips can be reduced. As long as the film can be an vibrating body capable of providing desired sound pressure characteristics, the film is not limited to the above organic materials. Alternatively, metal materials can also be applied.

[Manufacturing Method]

The method for manufacturing the acoustic generator according to the present invention will be described.

First, the piezoelectric element 1 is prepared. The piezoelectric element 1 is made by mixing binder, dispersant, plasticizer, and solvent into powder of piezoelectric material, thus making slurry. Either lead or non-lead materials can be used for the piezoelectric material.

Subsequently, the slurry is formed into a sheet shape, and a green sheet can be obtained. Internal electrode pastes are printed onto the green sheet, whereby the internal electrode pattern is formed. Three green sheets having the electrode patterns formed thereon are stacked, and in the uppermost layer, only the green sheet is stacked, thereby a laminated formation body is formed.

Subsequently, the laminated formation body is degreased and fired, and cut into a predetermined size, and thus the laminated body 13 can be obtained. As necessary, the external peripheral portion of the laminated body 13 is processed, and the surface electrode layers 15*a*, 15*b* are printed onto the principle surfaces, in the stacking direction, of the piezoelectric substance layer 7 of the laminated body 13. Subsequently, the external electrodes 17, 19 are printed onto both end surfaces of the laminated body 13 in the longitudinal direction x, and the electrodes are fired in the laminated body 13 at a predetermined temperature. As a result of the above steps, the piezoelectric element 1 as shown in FIGS. 1A and 1B can be obtained.

Subsequently, in order to give piezoelectric property to the piezoelectric element 1, a direct current voltage is applied via the surface electrode layers 15*a*, 15*b* or the external electrodes 17, 19, so that the piezoelectric substance layer 7 of the piezoelectric element 1 is polarized. Such polarization is done by applying a DC voltage so that the directions as shown in FIG. 1B are attained.

Subsequently, the film 3 serving as a support body is prepared, and the film 3 is fixed to the frame member 5. For example, in the configuration where the film 3 is sandwiched from the directions of both sides in the vertical direction as shown in FIG. 1B, the external peripheral portion of the film 3 is sandwiched between the frame members 5*a*, 5*b*, and is fixed while tension is given to the film 3. At this occasion, a bonding material is applied in advance to a portion where the film 3 is sandwiched by the frame member 5*a*. When the film 3 is sandwiched by the frame members 5*a*, 5*b*, they are pressed thereon so that the bonding material is pushed out onto the film 3 inside of the frame of the frame members 5*a*, 5*b*, so that the extended portion 22*a* of the bonding material is formed after the curing. In this case, the amount of extension (the width of extension) of the extended portion 22*a* is adjusted by the amount of the applied bonding material and the pressurizing force.

Subsequently, the bonding material is applied to a particular area of the surface of the film 3 so as to bond the piezoelectric element, and the surface electrode layers 15*a* of the piezoelectric element 1 is pressed onto the film 3. Thereafter, the bonding material is heated, or ultraviolet ray is irradiated to the bonding material, so that the bonding material is cured.

Subsequently, a resin which becomes the resin layer 20 is poured into the inside of the frame member 5*a* so as to cover the piezoelectric element 1. Then, the piezoelectric element 1 is completely buried therein, and the resin layer 20 is cured. Thereby, the acoustic generator according to the first embodiment can be obtained.

The acoustic generator configured as described above has the extended portion 22*a* of the bonding material on the film 3 inside of the frame of the frame member 5*a*. Therefore, in the acoustic generator according to the first embodiment, the displacement of the vibration in each area of the film 3 is uneven, and as a result, when the film 3 vibrates, the sound pressure peak becomes gentle at the resonance point, and the peak dip is suppressed, whereby the frequency characteristics can be flattened.

The example shown in FIGS. 1A, 1B shows a configuration in which the acoustic generator according to the first embodiment has the extended portion 22*a* of the bonding material 22 provided on the side in the lateral direction (the side indicated by W in FIG. 1A) of the inner edge of the frame member 5, but the present invention is not limited thereto. The extended portion 22*a* of the bonding material 22 may be formed on the side in the longitudinal direction (the side indicated by L in FIG. 1A) of the inner edge of the frame member 5. More specifically, when the bonding material is extended from between the frame member 5 and the film 3 to at least one portion of the film 3, the resonance frequency in each area of the film 3 can be made uneven, which can suppress the peak dip and flatten the frequency characteristics. It should be noted that the bonding material extended from the side in the longitudinal direction can actively flatten the frequency characteristics of lower sound, which is a low frequency with a long wavelength. Since the sound pressure of the lower sound than the resonance frequency can be gently attenuated, the sound range can be perceived as greater.

Figure 1D:
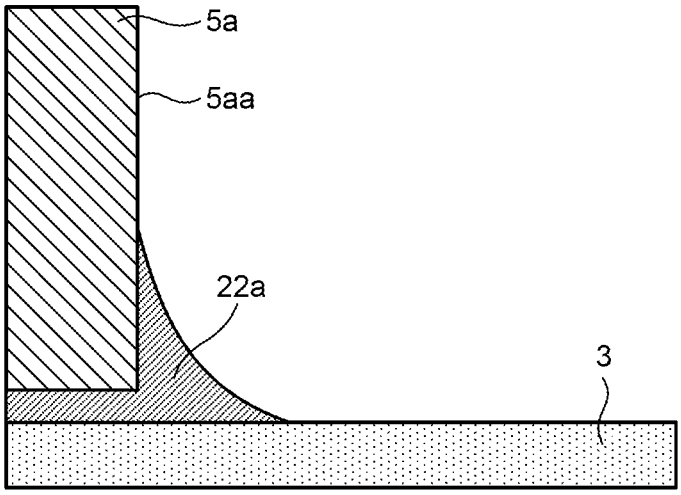
FIG. 1D is a cross sectional view for explaining an example in which the extended portion of the bonding material is in contact with an inner side surface of a frame member.

The extended portion 22*a* of the bonding material 22 that extends from the frame member 5*a* onto the film 3 in the frame may be in contact with an inner side surface 5*aa* of the frame member 5*a*. For example, FIG. 1D is a cross sectional view for explaining an example where the extended portion 22*a* of the bonding material 22 is in contact with the inner side surface of the frame member 5*a*. The example shown in FIG. 1D is similar to FIG. 1C in that the extended portion 22*a* of the bonding material 22 is formed from between the frame member 5*a* and the film 3 onto the film 3. However, in the example as shown in FIG. 1D, the extended portion 22*a* is in contact with the inner side surface 5*aa* of the frame member 5*a* so as to be along therewith, and in this case, the extended portion 22*a* is in a gentle concave meniscus shape which extends from the inner side surface 5*aa* of the frame member 5*a* to the end which is in contact with the film 3.

As describe above, when the extended portion 22*a* of the bonding material 22 extends to not only the film 3 but also the inner side surface of the frame member 5*a*, the peaks and the dips can be suppressed, and the frequency characteristics can be flattened, and in addition, the durability of the acoustic generator can be improved. When the extended portion 22*a* of the bonding material 22 is in a gentle concave meniscus shape which extends from the end which is in contact with the frame member 5*a* to the end which is in contact with the film 3, the binding force to the film 3 gently decreases toward the center of the film 3. Therefore, the binding of the vibration of the film 3 vibrating at various frequencies can be alleviated. As a result, the acoustic generator according to the first embodiment can stabilize the sound pressure, and can improve the durability.

When the extended portion 22*a* of the bonding material 22 is configured to extend onto the inner side surface 5*aa* of the frame member 5*a* or in a meniscus shape, this can be made as follows. For example, when the film 3 is sandwiched by the frame members 5*a*, 5*b*, an interface activator having a high degree of wettability with the bonding material is applied in advance to the inner side surfaces 5*aa* of the frame members 5*a*, 5*b*, and the bonding material is applied, and thereafter, the bonding material may be cured by heat or ultraviolet ray emission. FIG. 1A shows only the extended portion 22*a* of the bonding material for the sake of easy understanding, but the acoustic generator may be configured to have multiple extended portions formed in the same manner as the extended portion 22*a*.

Second Embodiment

The first embodiment has been hereinabove described, but an embodiment of the present disclosure can be carried out in various modes other than the mode described above. Therefore, in the description below, a acoustic generator in which a film 3 is sandwiched by frame members 5*a*, 5*b* and extended portions of bonding material are provided on both surfaces of the film 3 at the inside of frame members 5*a*, 5*b* will be described as a second embodiment, with reference to FIG. 2.

Figure 2:
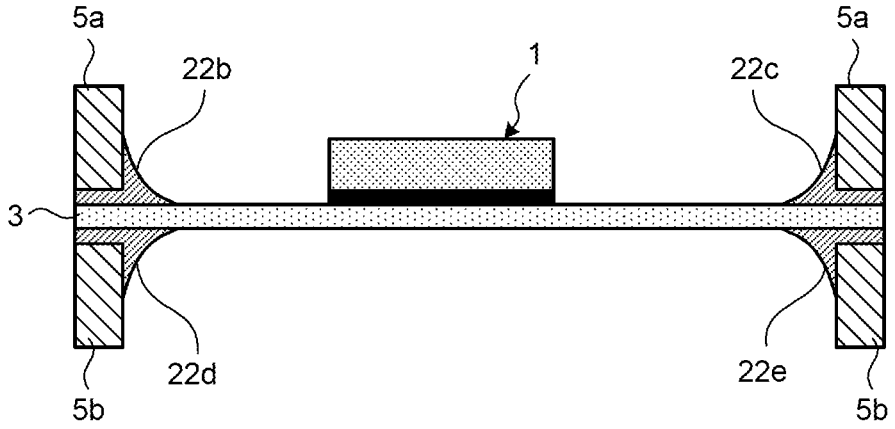
FIG. 2 is a cross sectional view illustrating an acoustic generator according to a second embodiment.

FIG. 2 is a cross sectional view illustrating the acoustic generator according to the second embodiment. Like FIG. 1B, FIG. 2 shows a cross sectional view taken along in the longitudinal direction of the acoustic generator according to the second embodiment, and in FIG. 2, the resin layer is not illustrated for the sake of easy understanding. As shown in FIG. 2, like the acoustic generator according to the first embodiment, the acoustic generator according to the second embodiment has a piezoelectric element 1 pasted on the upper surface of the film 3, and has extended portions 22*b*, 22*c* of the bonding material which are extended on the film 3 inside of the frame from the frame member 5*a*. In addition, the extended portions 22*b*, 22*c* of the bonding material also extends to the film 3 and the inner side surfaces of the frame member 5*a*, and the cross sectional shape thereof is in a meniscus shape.

In the example shown in FIG. 2, on the lower surface of the film 3, the extended portions 22*d*, 22*e* of the bonding material are also formed to be extended on the film 3 inside of the frame of the frame member 5*b*. In this case, the extended portions 22*d*, 22*e* of the bonding material also extend to the film 3 and the inner side surfaces of the frame member 5*b*, and the cross sectional shape thereof is in a meniscus shape.

Note that, in this case, the extended portions 22*b* to 22*e* of the bonding material are also formed according to the same method as the first embodiment.

In the acoustic generator according to the second embodiment configured as described above, the film 3 is sandwiched by the frame members 5*a*, 5*b*, and the extended portions 22*b* to 22*e* of the bonding material are provided on both surfaces of the film 3 to extend on both surfaces of the film 3 inside of the frame from the frame members 5*a*, 5*b*. Therefore, while the acoustic generator according to the second embodiment can flatten the frequency characteristics, the durability can also be improved.

In the second embodiment, the extended portions 22*b* to 22*e* preferably extend to the film 3 and also to the inner side surfaces of the frame member 5, and the cross sectional shape thereof is preferably in a meniscus shape. Therefore, also in the acoustic generator according to the second embodiment, the vibration of the film 3 is less likely to be restricted. Accordingly, the sound pressure can be stabilized, and the durability can be improved.

Third Embodiment

The first embodiment and the second embodiment have been hereinabove described, but an embodiment of the present disclosure can be carried out in various modes other than the modes described above. Therefore, an acoustic generator according to a third embodiment of which amounts of extensions (the widths of extended portions) are different between both surfaces of a film 3 when seen in the top view will be hereinafter described with reference to FIG. 3.

Figure 3:
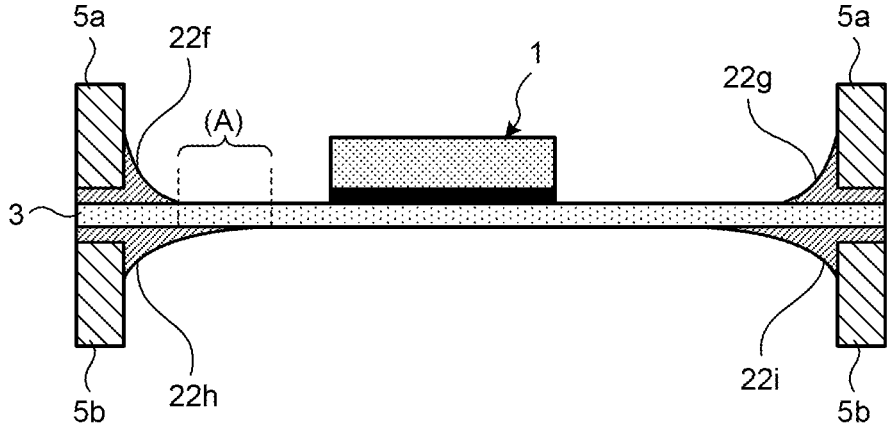
FIG. 3 is a cross sectional view illustrating an acoustic generator according to a third embodiment.

FIG. 3 is a top view illustrating the acoustic generator according to the third embodiment. Like FIG. 1B, FIG. 3 shows a cross sectional view taken along in the longitudinal direction of the acoustic generator according to the third embodiment, and in FIG. 3, the resin layer is not illustrated for the sake of easy understanding.

As shown in FIG. 3, like the acoustic generator according to the second embodiment, the acoustic generator according to the third embodiment has extended portions 22*f*, 22*g* of the bonding material formed on the upper surface of the film 3 extending from a frame member 5*a*, and has extended portions 22*h*, 22*i* of the bonding material on the lower surface of the film 3. The extended portions 22*f* to 22*i* extend to the inner side surfaces of the frame members 5*a*, 5*b* and also in the meniscus shape.

As indicated by (A) in FIG. 3, the width of the extended portion 22*f* of the bonding material which is extended onto the film 3 and the width of the extended portion 22*h* of the bonding material which is extended onto the film 3 are different. In this case, the difference in the widths is denoted as (A). More specifically, the size of an area of the extended portion 22*f* of the bonding material extended to the upper surface of the film 3 and the size of an area of the extended portion 22*h* of the bonding material extended to the lower surface of the film 3 are different from each other. Therefore, in the acoustic generator according to the third embodiment, there is a difference in the upper and lower amplitudes, and the resonance of the film itself can be suppressed. As a result, the sound pressure peak can be stretched widely at a low level at the resonance point of the film 3, and accordingly, the frequency characteristics can be flattened. In this case, the extended portions 22*f* to 22*i* may not be in contact with the inner side surfaces of the frame member 5.

In the third embodiment, the example where the widths of the extended portions 22*f* to 22*i* of the bonding material 22 formed at the upper and lower sides of the film 3 are configured to be different has been described. However, instead of changing the widths of the extended portions 22*f* to 22*i*, the extended portions 22*f*, 22*g* of the bonding material which extend on the upper surface of the film 3 and the extended portions 22*h*, 22*i* of the bonding material which extend on the lower surface of the film 3 may have different extension positions in the top view. For example, the extended portions 22*f*, 22*g* may extend from the sides in the lateral direction at the inner edge of the frame member 5, and the extended portions 22*h*, 22*i* may extend from the sides in the longitudinal direction at the inner edge of the frame member 5.

Further, the extended portions may be provided only on the upper surface of the film 3. Alternatively, the extended portions may be provided only on the lower surface of the film 3.

Fourth Embodiment

The first embodiment to the third embodiment have been hereinabove described, but an embodiment of the present disclosure can be carried out in various modes other than the modes described above. Therefore, an acoustic generator according to a fourth embodiment in which a film 3 is attached to a single frame member will be hereinafter described with reference to FIG. 4.

Figure 4:
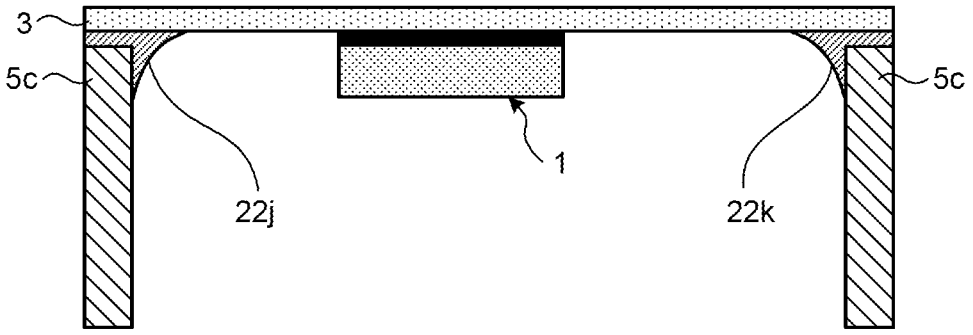
FIG. 4 is a cross sectional view illustrating an acoustic generator according to a fourth embodiment.

FIG. 4 is a cross sectional view illustrating the acoustic generator according to the fourth embodiment. As shown in FIG. 4, the acoustic generator according to the fourth embodiment has the film 3 stretched only on one side of a frame member 5*c*, and a piezoelectric element 1 is provided on the film 3 on the frame member 5*c* side. The film 3 is attached to the upper portion of the frame member 5*c* while tension is given thereto, and extended portions 22*j*, 22*k* of the bonding material are formed on the film 3 extended from the frame member 5*c*. In this case, the extended portions 22*j*, 22*k* extend on the inner side surface of the frame member 5*c*, and may be in a meniscus shape. The piezoelectric element 1 may be provided on the film 3 on the side opposite to the frame member 5*c*.

As described above, even when the frame member 5 is attached to only one side of the film 3, the resonance frequency in each area of the film 3 can be made uneven when the extended portions 22*j*, 22*k* of the bonding material are formed to be extended on the film 3 at the inside of the frame from the frame member 5*c*. Therefore, the peak dip can be suppressed, and the frequency characteristics can be flattened. Accordingly, the acoustic generator according to the fourth embodiment can suppress the peak dip and flatten the frequency characteristics regardless of, e.g., the structure of the frame member 5 and the position where the piezoelectric element 1 is attached.

Fifth Embodiment

The first embodiment to the fourth embodiment have been hereinabove described, but an embodiment of the present disclosure can be carried out in various modes other than the modes described above. Therefore, an acoustic generator in which an extended portion 22*l* of the bonding material formed on a film 3 is formed on the entire periphery of the inner edge of a frame member 5 while the width W of the extension is varied will be hereinafter described as a fifth embodiment with reference to FIG. 5.

Figure 5:
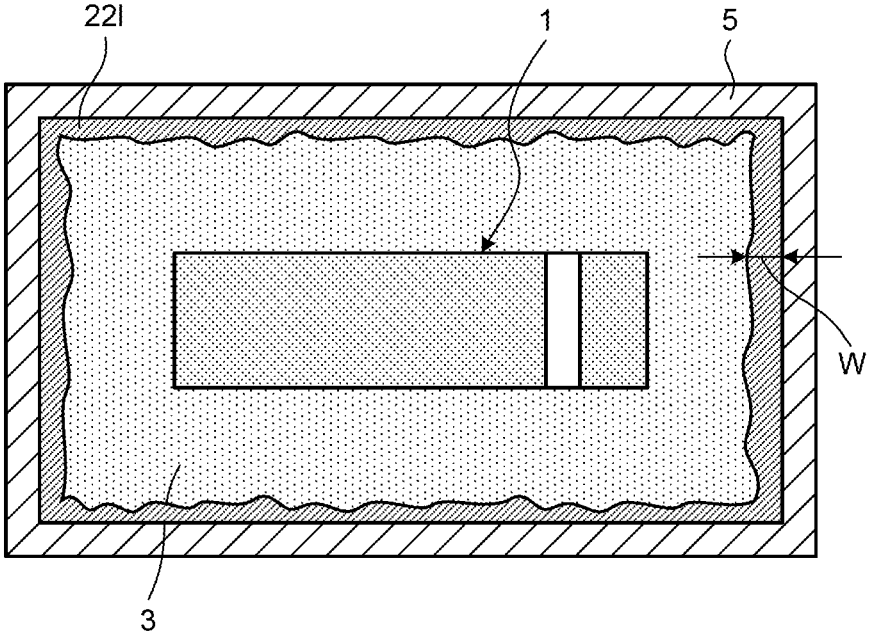
FIG. 5 is a top view illustrating an acoustic generator according to a fifth embodiment.

FIG. 5 is a top view illustrating the acoustic generator according to the fifth embodiment. In FIG. 5, the resin layer is not illustrated like FIG. 1A. As shown in FIG. 5, the acoustic generator according to the fifth embodiment has an extended part of the extended portion 22*l* of the bonding material provided on the entire periphery of the inner edge of the frame member 5. The extended portion 22*l* of the bonding material is configured such that the width W of the extension on the film 3 extended from the frame member 5 is different at each position. For example, when the film 3 is seen in the top view, at least a portion of the extended portion 22*l* is in an undulated shape.

The acoustic generator according to the fifth embodiment configured as described above can unevenly disperse the stress caused by the vibration of the film 3, and therefore, the durability against a crack can be improved. Since the acoustic generator according to the fifth embodiment has the extended portion 22*l* of the bonding material extended unevenly on the entire periphery of the inner edge of the frame member 5, the resonance frequency can be made uneven in each area of the film 3. Accordingly, the peak dip can be suppressed, and the frequency characteristics can be flattened.

Also in this case, the extended portion 22*l* of the bonding material may not be in contact with an inner side surface 5*aa* of a frame member 5*a*. The extended portion 22*l* of the bonding material may be in contact with the film 3 and the inner side surface 5*aa* of the frame member 5*a*, and the cross sectional shape may be a meniscus shape. In such case, the acoustic generator according to the fifth embodiment can stabilize the sound pressure and can further improve the durability.

Like the acoustic generator according to the second embodiment, the acoustic generator according to the fifth embodiment may have, on both sides of the film 3, the extended portion of the bonding material which is extended unevenly on the entire periphery of the inner edge of the frame member 5. In such case, the acoustic generator according to the fifth embodiment can further improve the durability. Like the acoustic generator according to the third embodiment, on the upper surface and the lower surface of the film 3, the acoustic generator according to the fifth embodiment may have different widths by which the extended portions extend onto the film 3 or may have different shapes in the top view. In such case, the acoustic generator according to the fifth embodiment can disperse the stress caused by the vibration of the film 3, and therefore, the durability against a crack can be improved. In addition, the sound pressure peak can be stretched widely at a low level. Therefore, the frequency characteristics can be further flattened. Like the acoustic generator according to the fourth embodiment, the acoustic generator according to the fifth embodiment may have the frame member 5 provided only on the upper surface of the film 3 or only on the lower surface of the film 3.

Sixth Embodiment

The embodiments have been hereinabove described, but an embodiment of the present disclosure can be carried out in various modes other than the modes described above. Therefore, other modes included in the present embodiments will be hereinafter described.

[Application of Voids to Bonding Material]

For example, the acoustic generators according to the first embodiment to the fifth embodiment have the extended portions 22*a* to 22*l* of the bonding material extended on the film 3 inside of the frame from the frame member 5. However, the embodiments are not limited thereto. For example, each of the extended portion 22*a* to 22*l* of the bonding material may have voids therein, i.e., may have so-called voids therein. An acoustic generator having an extended portion 22*m* including voids therein will be hereinafter described with reference to FIG. 6.

Figure 6:
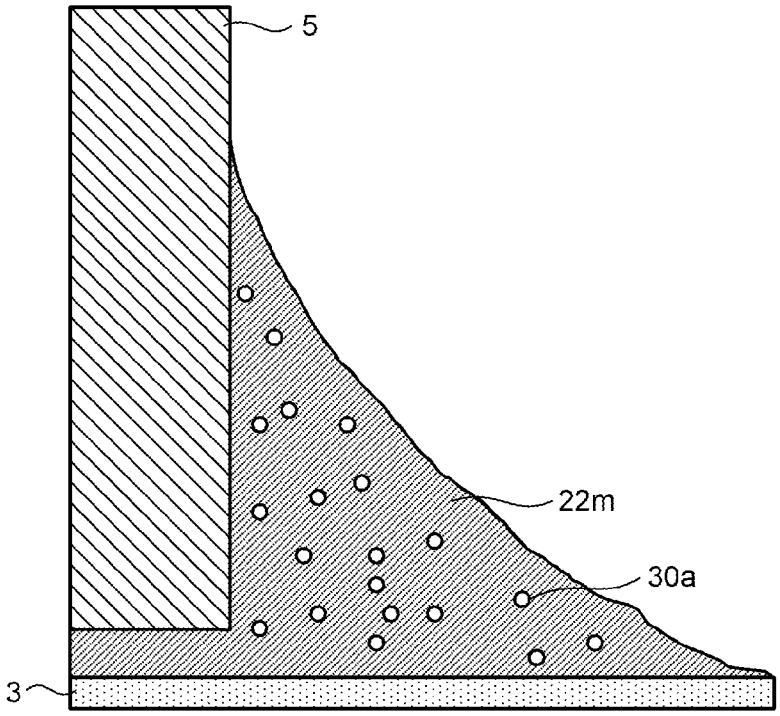
FIG. 6 is a cross sectional view illustrating an example in which voids are distributed in the extended portion of the bonding material.

FIG. 6 is a cross sectional view illustrating an example in which voids are dispersed in the extended portion of the bonding material. As shown in FIG. 6, the extended portion 22*m* is formed to be extended on the film 3 inside of the frame from the frame member 5, and the extended portion 22*m* extends to the inner side surface of the frame member 5. The extended portion 22*m* is in a meniscus shape.

In this case, the extended portion 22*m* includes many voids 30*a*. A typical example of the external shape of such void 30*a* is a spherical shape, but it may be in other shapes. As described above, when there are voids in the extended portion 22*m*, the stress generated by the vibration of the film 3 is concentrated on around the voids 30*a*. As a result, the voids 30*a* suppress propagation of the generated vibration at around the frame member 5 which is the node of the vibration, and accordingly, the noise generated by the frame member 5 can be suppressed, so that clear sound can be obtained. When the external shapes of the voids 30*a* are in the spherical shapes, the extended portion 22*m* can suppress the vibration generated at around the frame member 5 regardless of the propagation direction. Therefore, still more clear sound can be obtained.

Figure 7:
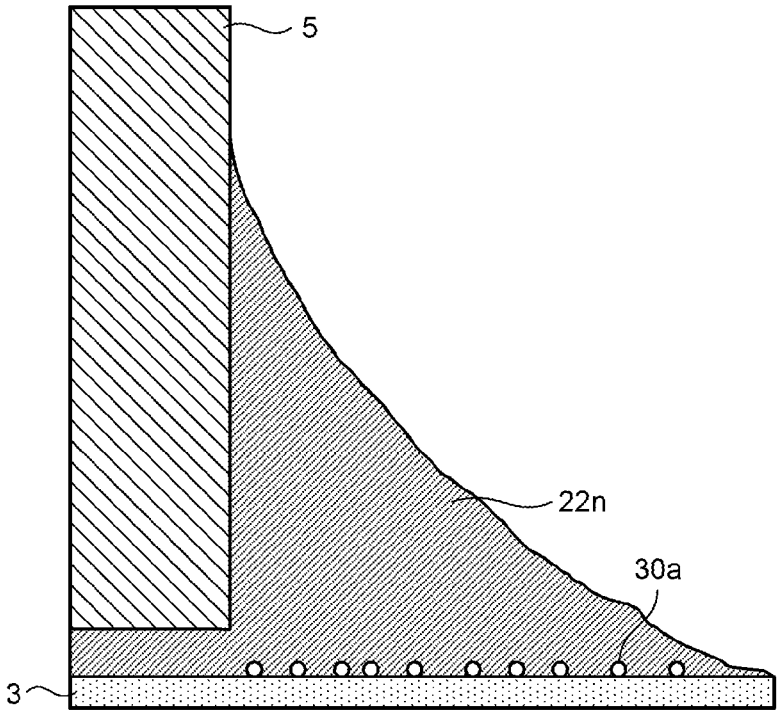
FIG. 7 is a cross sectional view illustrating an example in which voids are distributed at around an interface with the vibrating body.

It should be noted that the voids 30*a* may be distributed in the entire extended portion 22*m*. Alternatively, the voids may be distributed at around an interface with the film 3. For example, FIG. 7 is a cross sectional view illustrating an example in which voids are distributed at an interface with an vibrating body. In the example shown in FIG. 7, when the voids 30*a* are distributed at around an interface with the film 3, the extended portion 22*n* can effectively reduce the vibration by distributing many voids 30*a* at a position still closer to the vibrating film 3. Therefore, the difference of the peak dip of the sound pressure can also be effectively reduced.

Seventh Embodiment

In addition to the above embodiments, further, the bonding material may extend to an outside a of a frame member 5, and the extended bonding material may extend along the external side surface of the frame member 5. With the acoustic generator according to such embodiment, the frequency characteristics can also be flattened, and further the durability can be improved.

[Range of Application]

For example, in each of the above embodiments, the bimorph piezoelectric elements have been shown as an example. But the present disclosure is not limited thereto. More specifically, the present disclosure is not limited to a case where the piezoelectric element is a bimorph type. Even if it is a unimorph type, each of the above embodiments can be employed.

[Speaker Device]

Figure 8:
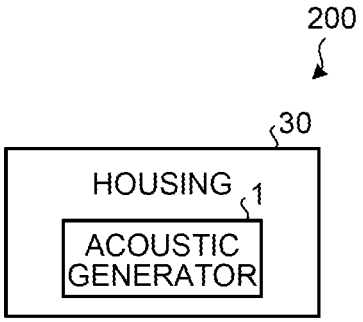
FIG. 8 is a view illustrating a configuration of an acoustic generating device according to an embodiment.

When the acoustic generator 1 is accommodated in a housing for accommodating the acoustic generator, which is a so-called resonance box, it can be configured as an acoustic generating device, i.e., a so-called "speaker device". FIG. 8 is a diagram illustrating a configuration of an acoustic generating device 200 according to an embodiment, and the acoustic generating device 200 will be described according to FIG. 8. In the figure, only constituent elements required for the description are shown, and generally-available constituent elements are not illustrated.

The acoustic generating device 200 is an acoustic generating device such as a so-called speaker, and as shown in FIG. 8 for example, the acoustic generating device 200 includes an acoustic generator 1 and a housing 30 for accommodating the acoustic generator 1. The housing 30 causes the sound generated by the acoustic generator 1 to resonate in the housing 30, and also emits the sound to the outside through an opening, not shown, formed in the housing 30. Since the housing 30 is provided, for example, the sound pressure can be enhanced in a low frequency band.

For example, the acoustic generating device 200 can be configured as a large speaker device used for a television set, a personal computer, and the like. Alternatively, the acoustic generating device 200 can be configured as a medium or a small speaker device incorporated into a mobile terminal such as a smartphone, a cellular phone, a PHS (Personal Handyphone System), and a PDA (Personal Digital Assistants). It should be noted that the speaker device is not limited to the above purposes, and be configured as a speaker device incorporated into any given electronic device such as a vacuum cleaner, a washing machine, and a refrigerator.

[Electronic Device]

Figure 9:
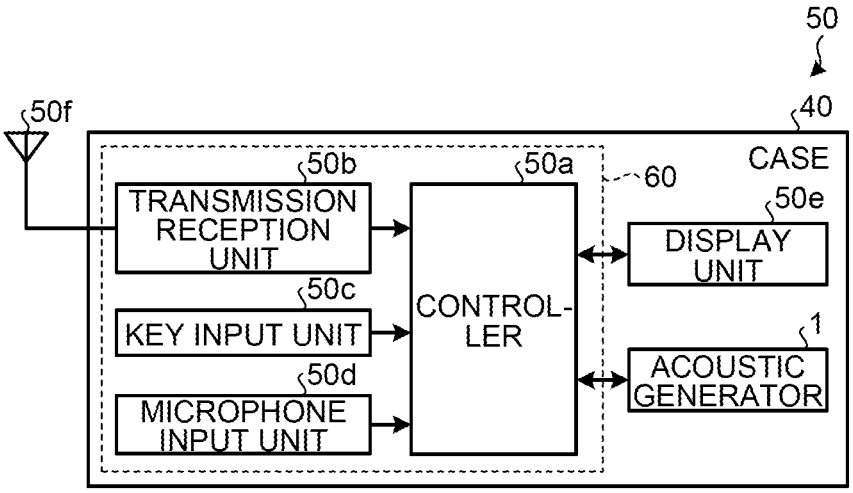
FIG. 9 is a view illustrating a configuration of an electronic device according to an embodiment.

Further, the acoustic generator 1 includes at least an electronic circuit connected to the acoustic generator and a housing for accommodating the electronic circuit and the acoustic generator, and can also be configured as an electronic device having a function of generating sound using the acoustic generator. FIG. 9 is a diagram illustrating a configuration of an electronic device 50 according to an embodiment, and the electronic device 50 will be described according to FIG. 9. In the figure, only constituent elements required for the description are shown, and generally-available constituent elements are not illustrated. In FIG. 9 shown below, the electronic device 50 is a portable terminal device such as a cellular phone and a tablet terminal.

As shown in FIG. 9, the electronic device 50 includes an electronic circuit 60. The electronic circuit 60 includes, for example, a controller 50*a*, a transmission reception unit 50*b*, a key input unit 50*c*, and a microphone input unit 50*d*. The electronic circuit 60 is connected to the acoustic generator 1, and has a function of outputting a sound signal to the acoustic generator 1. The acoustic generator 1 generates sound on the basis of the sound signal that is input from the electronic circuit 60.

The electronic device 50 includes a display unit 50*e*, an antenna 50*f*, and an acoustic generator 1. The electronic device 50 has a case 40 for accommodating these devices.

FIG. 9 shows the state where the devices such as the controller 50*a* are all accommodated in the single case 40, but the state of accommodation of the devices is not limited thereto. In the present embodiment, at least the electronic circuit 60 and the acoustic generator 1 need to be accommodated in the single case 40.

The controller 50*a* is a control unit for the electronic device 50. The transmission reception unit 50*b* transmits and receives data via the antenna 50*f* on the basis of the control of the controller 50*a*.

The key input unit 50*c* is an input device of the electronic device 50, and receives key input operation performed by an operator. Likewise, the microphone input unit 50*d* is an input device for the electronic device 50, and receives a sound input operation given by the operator.

The display unit 50*e* is a display output device for the electronic device 50, and outputs display information on the basis of the control of the controller 50*a*.

The acoustic generator 1 operates as a sound output device in the electronic device 50. It should be noted that the acoustic generator 1 is connected to the controller 50*a* of the electronic circuit 60, and generates sound in response to an applied voltage controlled by the controller 50*a*.

By the way, in FIG. 9, the description has been made based on the assumption that the electronic device 50 is a portable terminal device, but the type of the electronic device 50 is not limited thereto. This may be applied to various consumer devices having the function of generating sound. For example, this may be used for not only a flat-screen television set, a personal computer, various kinds of mobile terminals, a portable terminal, a mobile terminal, and car audio equipment but also products having a function of generating sound such as "speaking", which includes, various products, for example, a vacuum cleaner, a washing machine, a refrigerator, and a microwave oven.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

The invention claimed is:

1. An acoustic generator comprising:

a vibrating body;

a frame member attached by a bonding material so as to sandwich both sides of an external peripheral portion of the vibrating body; and an exciter provided on the vibrating body inside of a frame of the frame member, wherein an extended portion of the bonding material is provided to be extended on an inner side surface of the vibrating body inside of the frame from the frame member, amounts of extensions of the extended portion are different between an upper surface and a lower surface of the vibrating body when seen in a top view, the extended portion extends to an inner side surface of the frame member, and the extended portion is in a meniscus shape.

2. An acoustic generator comprising:

a vibrating body;

a frame member attached by a bonding material so as to sandwich both sides of an external peripheral portion of the vibrating body; and an exciter provided on the vibrating body inside of a frame of the frame member, wherein an extended portion of the bonding material is provided to be extended on an inner side surface of the vibrating body inside of the frame from the frame member, amounts of extensions of the extended portion are different between an upper surface and a lower surface of the vibrating body when seen in a top view, and the extended portion is formed on an entire periphery of an inner edge of the frame member while a width of the extended portion is varied.

3. The acoustic generator according to claim 1, wherein the extended portion has a void.

4. The acoustic generator according to claim 3, wherein the void is in a spherical shape.

5. The acoustic generator according to claim 1, wherein the exciter is a bimorph piezoelectric element.

6. The acoustic generator according to claim 1, wherein a resin layer is provided on the vibrating body and on the extended portion between the exciter and the frame member.

7. An acoustic generating device comprising at least:

the acoustic generator according to claim 1; and a housing configured to place therein the acoustic generator.

8. An electronic device comprising at least:

the acoustic generator according to claim 1;

an electronic circuit connected to the acoustic generator; and a case configured to place therein the electronic circuit and the acoustic generator, wherein a function for generating sound using the acoustic generator is provided.

9. The acoustic generator according to claim 2, wherein the extended portion has a void.

10. The acoustic generator according to claim 9, wherein the void is in a spherical shape.

11. The acoustic generator according to claim 2, wherein the exciter is a bimorph piezoelectric element.

12. The acoustic generator according to claim 2, wherein a resin layer is provided on the vibrating body and on the extended portion between the exciter and the frame member.

13. An acoustic generating device comprising at least:

the acoustic generator according to claim 2;

a housing configured to place therein the acoustic generator.

14. An electronic device comprising at least:

the acoustic generator according to claim 2;

an electronic circuit connected to the acoustic generator; and a case configured to place therein the electronic circuit and the acoustic generator, wherein a function for generating sound using the acoustic generator is provided.

* * * * *